US008122845B2

(12) United States Patent
Feijen

(10) Patent No.: US 8,122,845 B2
(45) Date of Patent: Feb. 28, 2012

(54) ENVELOPE FLAP MOISTENER

(75) Inventor: Fransiscus Hermannus Feijen, Leeuwarden (NL)

(73) Assignee: Neopost Technologies, Bagneux (FR)

( * ) Notice: Subject to any disclaimer, the term of this patent is extended or adjusted under 35 U.S.C. 154(b) by 21 days.

(21) Appl. No.: 12/696,602

(22) Filed: Jan. 29, 2010

(65) Prior Publication Data

US 2010/0192853 A1 Aug. 5, 2010

(30) Foreign Application Priority Data

Jan. 30, 2009 (EP) ..... 09151760

(51) Int. Cl.
*B05C 11/00* (2006.01)

(52) U.S. Cl. ..... 118/263; 118/264

(58) Field of Classification Search ..... 118/263–264
See application file for complete search history.

(56) References Cited

U.S. PATENT DOCUMENTS

| | | | | |
|---|---|---|---|---|
| 3,410,053 | A | 11/1968 | Bonsch | |
| 3,550,351 | A | 12/1970 | Gombault | |
| 3,706,274 | A * | 12/1972 | Coville | 118/263 |
| 3,911,862 | A | 10/1975 | Lupkas | |
| 3,936,993 | A | 2/1976 | Dorer | |
| 4,038,941 | A | 8/1977 | Swaniger | |
| 4,380,210 | A | 4/1983 | Auerbach | |
| 4,428,794 | A | 1/1984 | Hayskar et al. | |
| 4,924,106 | A | 5/1990 | Tolmie, Jr. | |
| 4,924,805 | A | 5/1990 | O'Dea | |
| 5,006,194 | A | 4/1991 | Schmaling | |
| 5,088,442 | A * | 2/1992 | Joson et al. | 118/238 |
| 5,104,470 | A | 4/1992 | Ritchie | |
| 5,145,709 | A | 9/1992 | Bergman | |
| 5,242,499 | A | 9/1993 | Bergman | |
| 5,326,587 | A | 7/1994 | Bergman | |
| 5,354,407 | A | 10/1994 | Hubbard et al. | |
| 5,525,185 | A | 6/1996 | Holbrook et al. | |
| 5,569,327 | A * | 10/1996 | Paradis et al. | 118/253 |
| 5,665,198 | A | 9/1997 | Bieber et al. | |
| 5,674,348 | A | 10/1997 | DeFiguerido | |
| 5,770,005 | A | 6/1998 | Staniszewski | |
| 5,976,313 | A | 11/1999 | Maguire, III | |
| 6,193,825 | B1 | 2/2001 | Dolan | |
| 6,346,149 | B1 | 2/2002 | Gregoire et al. | |
| 6,361,603 | B1 | 3/2002 | Salomon | |

(Continued)

FOREIGN PATENT DOCUMENTS

| | | |
|---|---|---|
| FR | 1 382 154 A | 12/1964 |
| GB | 1 084 262 A | 9/1967 |
| GB | 2 232 615 A | 12/1990 |
| GB | 2297707 A | 8/1996 |

*Primary Examiner* — Dah-Wei Yuan
*Assistant Examiner* — Stephen Kitt
(74) *Attorney, Agent, or Firm* — Sughrue Mion, PLLC

(57) ABSTRACT

An envelope (5) flap (6) moistener has a moisture transfer member (4; 104) for transferring liquid adhering thereto to a flap (6) of an envelope (5). An encapsulation (11, 22; 110, 111, 122) containing the moisture transfer member (4; 104) is equipped with a cap (22; 122) suspended movably between a closed position and an open position. The encapsulation (11, 22; 110, 111, 122) encapsulates at least a portion of the moisture transfer member (4; 104) including a contact surface (12; 112) for contacting envelope (5) flap (6)s to be moistened when the cap (22; 122) is in the closed position and leaves the contact surface (12; 112) of the moisture transfer member (4; 104) exposed for allowing the contact surface (12; 112) to contact an envelope (5) flap (6) when the cap (22; 122) is in the open position.

2 Claims, 3 Drawing Sheets

U.S. PATENT DOCUMENTS

| | | | |
|---|---|---|---|
| 6,554,956 | B1 | 4/2003 | Dolan et al. |
| 6,708,467 | B2 | 3/2004 | Antonelli et al. |
| 6,913,054 | B2 | 7/2005 | Miller et al. |
| 6,948,540 | B2 | 9/2005 | Brignell et al. |
| 7,364,621 | B2 | 4/2008 | Defosse et al. |
| 2003/0136337 | A1 | 7/2003 | Gregoire et al. |

* cited by examiner

ENVELOPE FLAP MOISTENER

FIELD AND BACKGROUND OF THE INVENTION

The invention relates to an envelope flap moistener. Envelope flap moisteners are typically used for moistening one or more strips of adhesive material such as arabic gum on a flap of an envelope prior to closing the flap in an inserting apparatus for inserting postal items into the envelope, moistening the strips on the envelope flap and closing the envelope flap. Such envelope flap moisteners typically have an envelope transport track. An envelope is transported along the envelope track such that the flap to be moistened and closed is passed along a moisture transfer member. Moisture is transferred from the moisture transfer member to the adhesive material, which becomes to some extent liquefied and sticky when water is applied thereto. Then the flap is mechanically closed and the adhesive sticks to the body of the envelope and is to some extent absorbed by the envelope body, so that a strong joint between the flap and the body of the envelope is obtained. In practice, the joint is generally so strong that the flap cannot be disconnected from the envelope body without damaging the envelope. Thus, the adhesive also constitutes a sealing material.

During operation of inserting apparatus, the dosage of liquid (generally simply water) should be such that the adhesive is moistened sufficiently to obtain a sufficiently strong bond between the body and the flap of the envelope, but not excessively to avoid excessive wrinkling of the envelope or even damage to the contents of the envelope. When the apparatus is operating in an essentially steady state condition, moistening a fairly constant number of envelope flaps per unit of time, providing a proper dosage of liquid is generally no problem. However, when the apparatus is started after having been out of operation for a longer period, e.g. more than an hour or several hours, it is often a problem to ensure quickly that the liquid is properly dosed as of the first envelopes of a series of mail pieces.

SUMMARY OF THE INVENTION

It is an object of the present invention to provide a simple solution to facilitate dosing amounts of liquid to be applied to envelope flaps of a series of envelopes as of the first envelopes of that series, even if the apparatus for moistening envelopes has been inactive for a prolonged period of time immediately previous to the start of closing the series of envelopes.

According to the invention, this object is achieved by providing an envelope moistener having a moisture transfer member for transferring liquid adhering thereto to a flap of an envelope, a support for supporting an envelope in a flap moistening position with a flap of the envelope in contact with a contact surface of the moisture transfer member, a liquid reservoir communicating with the moisture transfer member for feeding liquid to the moisture transfer member; and an encapsulation containing the moisture transfer member, the encapsulation having a cap suspended movably between a closed position and an open position and the encapsulation encapsulating at least a portion of the moisture transfer member including the contact surface when the cap is in the closed position and leaving the contact surface of the moisture transfer member exposed for allowing the contact surface to contact an envelope flap when the cap is in the open position.

By encapsulating at least a portion of the moisture transfer member including the contact surface from all sides when the cap is in the closed position, that portion of the moisture transfer member is fully shielded from the environment, so that evaporation of moisture is counteracted. Thus, the moisture transfer member will dry out less, so adequate amounts of liquid are dosed readily to the first flaps of a series of envelopes even if the apparatus has been out of operation for a prolonged period immediately preceding the moistening of the first envelopes of a series.

The cap is moreover suspended such that it leaves the contact surface of the moisture transfer member exposed for allowing the contact surface to contact an envelope flap when the cap is in the open position. Thus, the envelope flap moistener can be put into operation, without removing the cap from the apparatus.

Particular elaborations and embodiments of the invention are set forth in the dependent claims.

Further features, effects and details of the invention appear from the detailed description and the drawings.

DETAILED DESCRIPTION

Figure 2:
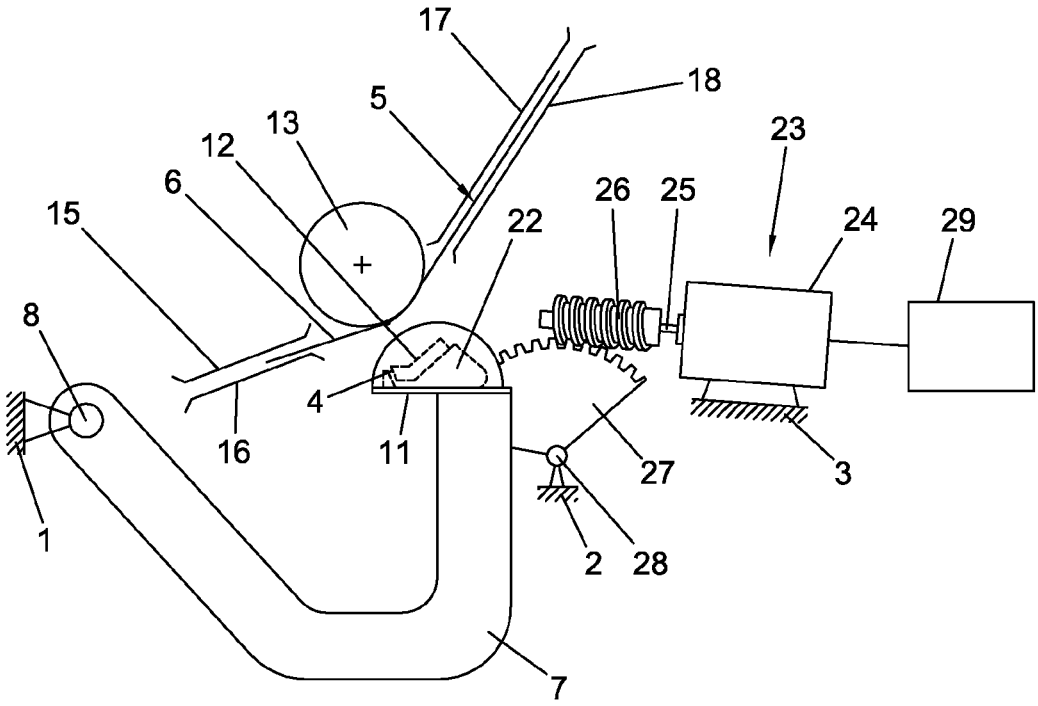
FIG. 2 is a schematic representation of a side view of the apparatus according to FIG. 1 in a different operating condition.
Figure 3:
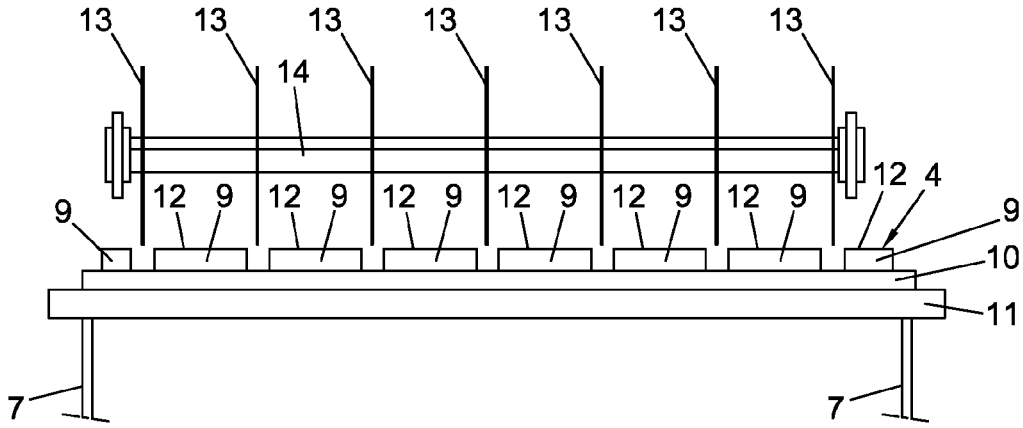
FIG. 3 is a schematic representation of a view along the lines III-III in FIG. 1.

A first example of an envelope flap moistener is described with reference to FIGS. 1-3.

A housing and support frame of the apparatus has schematically been designated by hatched portions 1-3. A moisture transfer member 4 for transferring liquid adhering thereto to a flap 6 of an envelope 5 is mounted to an arm 7 that is hinged to the housing about a pivot axis 8. The moisture transfer member 4 has a plurality of moistening brush portions 9 that are held by brush holder 10, which is mounted to a bridge member 11 interconnecting the arms 7 on opposite side of the apparatus. The moisture transfer member 4 may also be constituted or include one or more liquid absorbing structures including small cavities for retaining and dispensing liquid, such as a sponge, felt or woven or braided elements.

A support for supporting the envelope 5 in a flap moistening position (see FIG. 1), with the flap 6 of the envelope 5 in contact with a contact surface 12 of the moisture transfer member 4, is constituted by a set of pressing disks 13 mounted to a pressing axis 14 which is rotatably suspended to the frame 1-3 and by envelope path guides 15-18.

A liquid reservoir 19 communicates via a liquid transfer conduit 20 and a pump 21 (not shown in FIG. 2) with the moisture transfer member 4 for feeding liquid to the moisture transfer member 4.

For counteracting evaporation of liquid from the moisture transfer member 4, an encapsulation containing the moisture transfer member 4 is provided. The encapsulation includes a cap 22 suspended movably between a closed position shown in FIG. 2 and an open position shown in FIG. 1. In the present example, the encapsulation further includes the bridge member 11 against which a rim of the cap 22 rests when in the closed position.

When the cap 22 is in the closed position, the encapsulation encapsulates the brush portions 9 of the moisture transfer member 4 including the contact surfaces 12 from all sides, so that evaporation of liquid from the moisture transfer member 4, and in particular from the contact surfaces 12 thereof is effectively counteracted. The cap 22 in the closed position covers the contact surfaces 12 of the moisture transfer member 4, which are exposed to allow an envelope flap access thereto when the cap 22 is in its open position.

Depending on the extent to which counteracting evaporation is desired, the cap 22 may sealingly contact the bridge member 11 so that moisture transfer member 4 is hermetically encapsulated or leave slight gaps or slits between its rim and the bridge member 11 when in closed condition. The latter may be advantageous for facilitating opening of the cap 22 and avoiding subjecting the moisture transfer member to pressure variations and associated displacements of liquid to and from the reservoir 19 when the cap 22 is opened and closed. Preferably such gaps or slits are narrower than 1 or 2 mm, the moisture transfer member 4 otherwise being hermetically enclosed and shielded from the environment.

Figure 1:
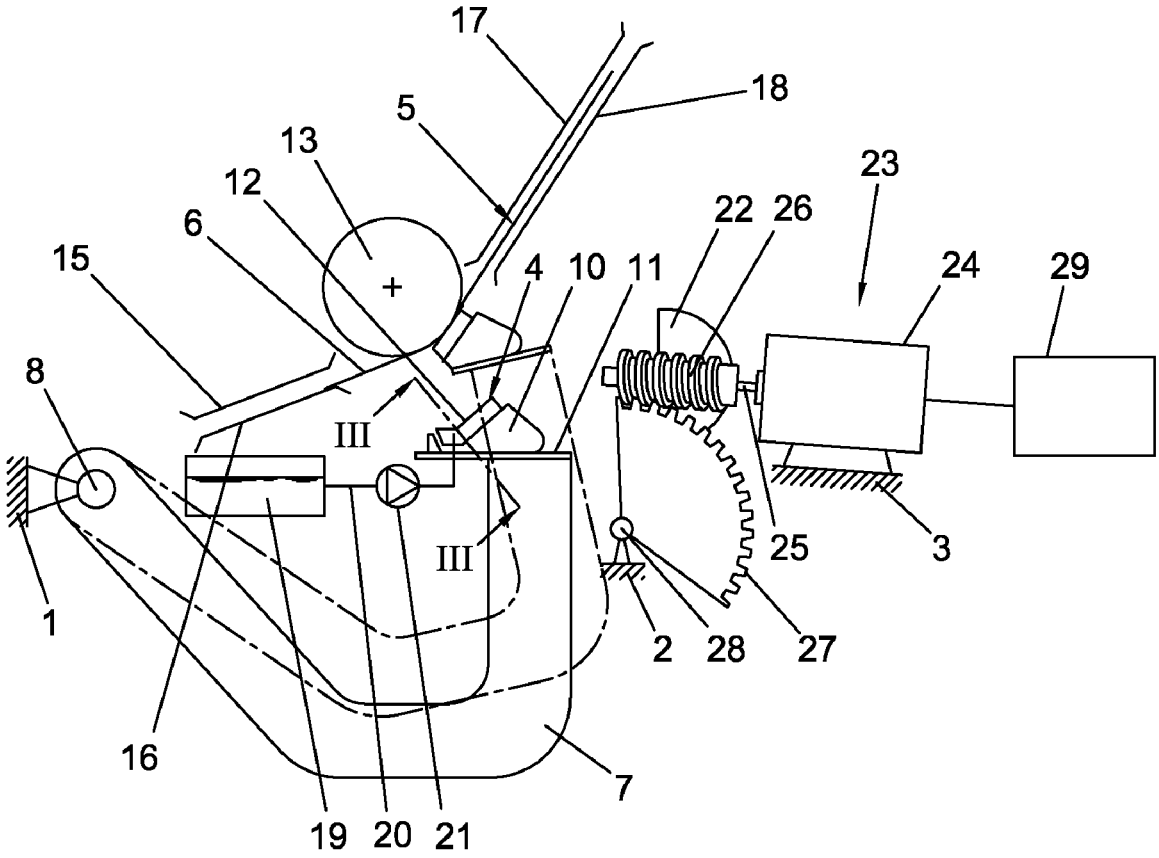
FIG. 1 is a schematic representation of a side view of a first example of an apparatus according to the invention.

As is shown in FIG. 1, when the cap 22 is in the open position, it leaves the contact surfaces 12 of the moisture transfer member 4 exposed for allowing the contact surfaces 12 to contact an envelope flap 6. In FIG. 1, a representation in dash-and-dot lines shows the arm 7 and the moisture transfer member 4 in a position with the contact surfaces 12 contacting an envelope flap 6. As can be seen from FIGS. 1 and 2, the moisture transfer member 4 is movable between a moistening position projecting to an envelope flap position for moistening the envelope flap 6 and a retracted position retracted relative the moistening position.

For moving the cap 22 between the open and the closed position, a cap drive 23 is provided, which is connected to the cap 22 for moving the cap 22 between the open position and the closed position. In the example shown in FIGS. 1-3, the cap drive 23 includes an electric motor 24 mounted to the frame 1-3, a shaft 25 drivable by the electric motor 24, a worm wheel 26 coupled to the shaft 25 so as to rotate with the shaft 25, a gear wheel segment 27 pivotably suspended relative to the frame 1-3 about a pivot axis 28 and having teeth engaging a helical profile in the circumference of the worm wheel 26. The cap 22 is fixedly connected to the gear wheel segment 27 so that the cap 22 pivots with the gear wheel segment 27 about the pivot axis 28 when the motor 24 drives rotation of the shaft 25 about its centre line.

A control circuitry 29 is connected to the motor 24 for controlling the motor 24 and, accordingly, the cap drive 23. The control circuitry 29 is arranged for controlling the cap drive 23 for causing the cap 22 to open in response to activation of the envelope flap opener for successively moistening a plurality of envelopes, for leaving the cap 22 open between moistening of the envelopes, and for causing the cap 22 to close in response to de-activation of the envelope moistener after completion of moistening the plurality of envelopes. Thus, the cap 22 closes automatically, each time a job of moistening flaps of a series of envelopes is completed or at least if the envelope moistener is switched off. Movement of the cap 22 does not interfere with operation of the apparatus while evaporation of liquid is counteracted between periods of operation in which, due to the often prolonged durations of such non-operating periods (from one to two hours to a day or more), the problem of drying out of the moisture transfer member 4 between periods of operation is most relevant. The control circuitry 29 may be connected to a control system for controlling the envelope flap moistener, of the inserter system or of a system for preparing items to be mailed for receiving signals indicating whether the system is active for processing a series of envelopes or inactive after completion of processing a series of envelopes and awaiting a command to process a next batch of envelopes. An inactive signal may also be provided if a feeder for feeding contents or envelopes is empty and the system for preparing items to be mailed is waiting for the feeding station to be reloaded.

To further counteract evaporation of moisture and also for reducing humidity inside an inserting station, it may be provided that the control circuitry 29 is arranged for controlling the cap drive 23 for causing the cap 22 to open each time the moisture transfer member 4 is moved to the moistening position and for controlling the cap drive 23 for causing the cap 22 to close each time the moisture transfer member 4 is moved to the retracted position.

Figure 4:
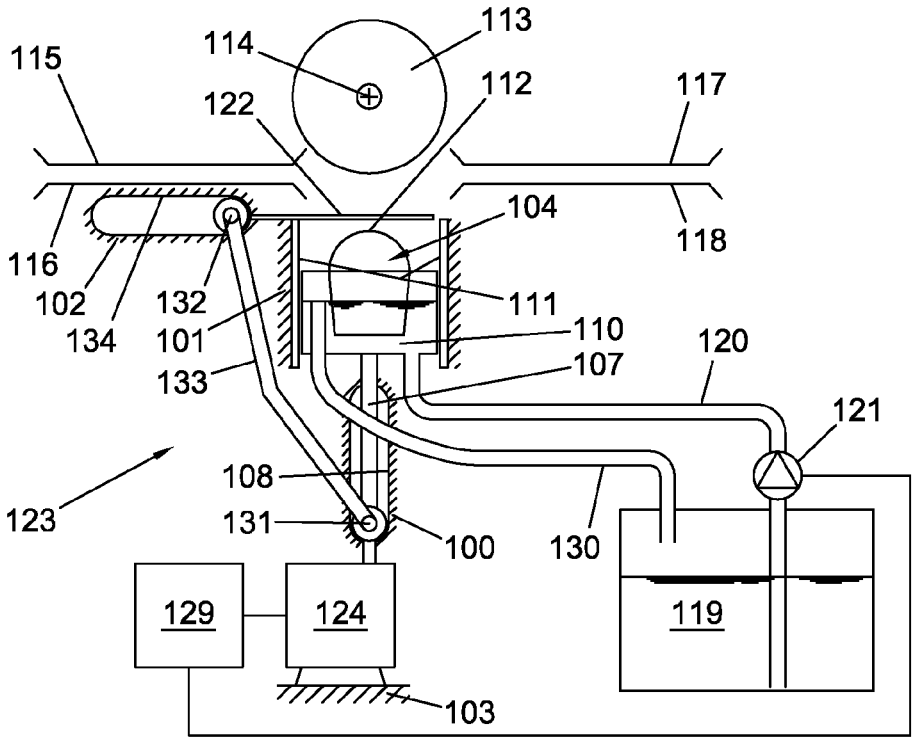
FIG. 4 is a schematic representation of a side view of a second example of an apparatus according to the invention.
Figure 5:
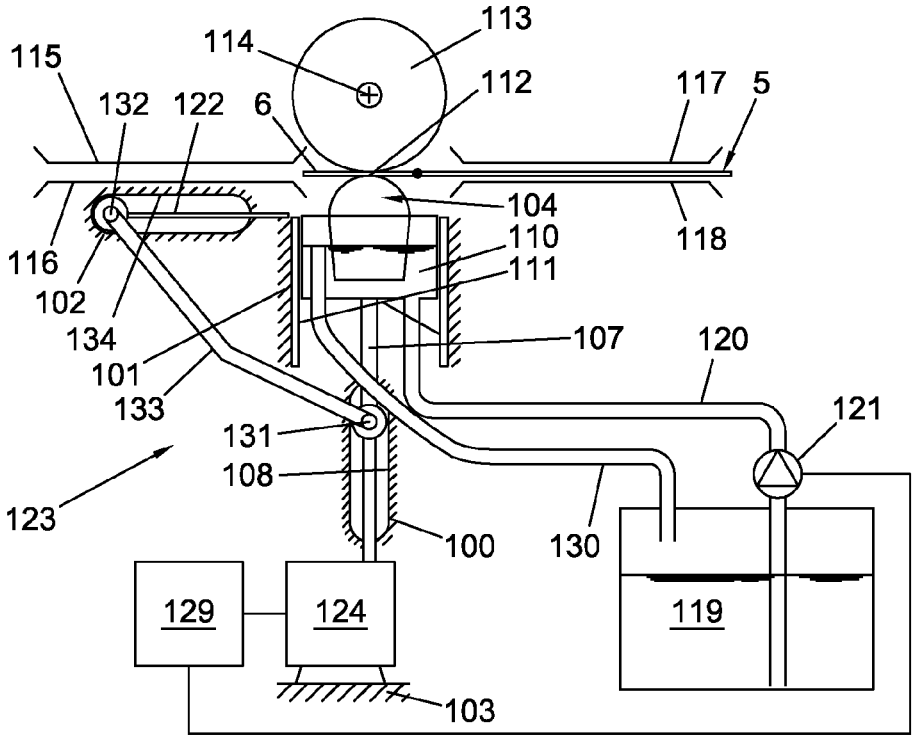
FIG. 5 is a schematic representation of a side view of the apparatus according to FIG. 4 in a different operating condition.

In FIGS. 4 and 5 a second example of an envelope flap moistener according to the invention is shown.

A housing and support frame of the apparatus has schematically been designated by hatched portions 100-103. A moisture transfer member 104 for transferring liquid adhering thereto to a flap 6 of an envelope 5 is mounted to a push rod 107 that is connected to a pin 131 guided in a slot 108 in the housing.

A support for supporting the envelope 5 in a flap moistening position (see FIG. 5), with the flap 6 of the envelope 5 in contact with a contact surface 112 of the moisture transfer member 104, is constituted by a set of pressing disks 113 mounted to a pressing axis 114 which is rotatably suspended to the frame 100-103 and by envelope path guides 115-118.

A liquid reservoir 119 communicates via a liquid transfer conduit 120 and a pump 121 with the moisture transfer member 104 for feeding liquid to the moisture transfer member 104. The moisture transfer member 104 is mounted to a holder 110 which also bounds a chamber for holding a volume of liquid for keeping the moisture transfer member 104 moist. An overflow conduit 130 has an inlet at a level determining the level of liquid in the chamber and allows excess amounts of liquid to flow back to the reservoir 119. The pump 121 is connected to a control circuitry 129 for receiving commands to pump liquid into the holder 110 at regular intervals, for instance each time after moistening one or a plurality of envelope flaps.

The moisture transfer member 104 is movable between a moistening position projecting to an envelope flap position for moistening an envelope flap 6 (see FIG. 5) and a retracted position retracted relative to the moistening position (see FIG. 4). For driving this movement back and forth, according to the present example, the push-rod 107 is connected to a drive unit 124 including a motor and a gear box. The drive unit 124 is mounted to the frame portion 103 and coupled to the control circuitry 129 for moving the push-rod 107 back and forth such that the moisture transfer member 104 is pushed from the retracted position to the moistening position each time an envelope flap 6 passes the pressing member 113 and is to be moistened. Thereafter, the drive unit 124 is controlled to retract the moisture transfer member 104 to the retracted position.

For counteracting evaporation of liquid from the moisture transfer member 104, an encapsulation containing the moisture transfer member 104 is provided. The encapsulation includes a cap 122 suspended movably between a closed position shown in FIG. 4 and an open position shown in FIG. 5. In the present example, the encapsulation further includes walls 111 bounding a passage in which the holder 110 is movable. The holder 110 rests against the surfaces of the walls 111, such that the passage is effectively closed off. When the cap 122 is in the closed position, the cap 122, the walls 111 and the holder 110 constitute an encapsulation of the moisture transfer member 104, which counteracts evaporation of liquid from the moisture transfer member 104. Depending on the extent to which counteracting evaporation is desired, the cap 122, the walls 111 and the holder 110 may be in sealing contact or leave slight gaps or slits in-between when the cap 122 is in closed condition. Preferably such gaps or slits are narrower than 1 or 2 mm.

As is shown in FIG. 5, when the cap 122 is in the open position, it leaves the contact surfaces 112 of the moisture transfer member 104 exposed and allows the moisture transfer member 104 to be in the moistening position shown in FIG. 5 contacting an envelope flap 6.

For moving the cap 122 between the open and the closed position, the cap 122 is coupled to the moisture transfer member 104 so that the cap 122 moves to the open position when the moisture transfer member 104 moves to the moistening position and the cap 122 moves to the closed position when the moisture transfer member 122 moves to the retracted position. In the present example, this coupling is realized by a connecting bar 133 linking the pin 131 connected to the push-rod 107, which is guided in the slot 108 to a further pin 132 coupled to the cap 122 and guided in a further slot 134 defining a direction in which the cap 122 is movable back and forth. When the pin 131 coupled to the push-rod 107 moved upwardly for driving displacement of the moisture transfer member 104 from the retracted position to the moistening position, the connecting bar 133 pushes the further pin 132 away from the moisture transfer member 104 in a direction transverse to the direction of movement of the moisture transfer member 104, thereby retracting the cap from the closed position to the open position, leaving room for the moisture transfer member 104 to pass from the retracted position to the moistening position. When the moisture transfer member 104 moves back to the retracted position, the connecting bar 133 pulls back the further pin 132 and the cap 122 attached thereto back so that the cap 122 is displaced back to the closed position.

Since the cap 122 is coupled to the moisture transfer member 104 so that the cap 122 moves to the open position when the moisture transfer member 104 moves to the moistening position and the cap 122 moves to the closed position when the moisture transfer member 104 moves to the retracted position, no separate motor is needed to drive the displacements of the cap 122.

It will be clear to the skilled person that within the framework of the present invention as defined by the claims, many other embodiments than the above described embodiments are conceivable. For instance, the movement of the cap between the open and the closed position may be driven or triggered by the passage of an envelope of which the flap is to be moistened and/or has been moistened. Feeding of liquid to the moisture transfer member may be realized without pumps, for instance using capillary effects and/or gravity. Furthermore, the encapsulation may be partially integrated with the reservoir.

Instead of Arabic gum, the adhesive to be moistened may also be another adhesive that become liquid and/or sticky when water or another solvent is applied thereto, such as a natural adhesive made from inorganic mineral sources, or biological sources such as vegetable matter, starch (dextrin), natural resins or from animals e.g. casein or animal glue.

The invention claimed is:

1. An envelope flap moistener comprising:

a housing and support frame;

a moisture transfer member for transferring liquid adhering thereto to a flap of an envelope, said moisture transfer member having a plurality of moistening portions and a moistening portion holder for holding said plurality of moistening portions;

a support for supporting an envelope in a flap moistening position with a flap of the envelope in contact with a contact surface of the moisture transfer member;

a liquid reservoir communicating with the moisture transfer member for feeding liquid to the moisture transfer member; and an encapsulation containing the moisture transfer member;

the encapsulation having a cap suspended movably relative to said housing and support frame between a closed position and an open position; and the encapsulation encapsulating at least a portion of the moisture transfer member including the contact surface from all sides when the cap is in the closed position and leaving the contact surface of the moisture transfer member exposed for allowing the contact surface to contact an envelope flap when the cap is in the open position, wherein the moisture transfer member including said plurality of moistening portions and said moistening portion holder is movable relative to said housing and support frame between a moistening position projecting to an envelope flap position for moistening an envelope flap and a retracted position retracted relative the moistening position, and wherein the cap is coupled to the moisture transfer member including said plurality of moistening portions and said moistening portion holder so that the cap moves to the open position when the moisture transfer member including said plurality of moistening portions and said moistening portion holder moves to the moistening position and the cap moves to the closed position when the moisture transfer member including said plurality of moistening portions and said moistening portion holder moves to the retracted position;

wherein the envelope flap moistener further comprises:

a cap drive connected to the cap for moving the cap relative to said housing and support frame between the open position and the closed position; and control circuitry for controlling the cap drive, the control circuitry being programmed for controlling the cap drive for causing the cap to open in response to activation of the envelope flap moistener for successively moistening a plurality of envelopes, for leaving the cap open between moistening of the envelopes of said plurality, and for causing the cap to close in response to de-activation of the envelope moistener after completion of moistening the plurality of envelopes.

2. An envelope flap moistener according to claim 1, wherein the moisture transfer member including said plurality of moistening portions and said moistening portion holder is movable relative to said housing and support frame between a moistening position projecting to the envelope flap moistening position for moistening an envelope flap and a retracted position retracted relative the moistening position, and wherein the control circuitry is programmed for controlling the cap drive for causing the cap to open each time the moisture transfer member including said plurality of moistening portions and said moistening portion holder is moved to the moistening position and for controlling the cap drive for causing the cap to close each time the moisture transfer member including said plurality of moistening portions and said moistening portion holder is moved to the retracted position.

* * * * *